US008720460B2

(12) United States Patent
Chen et al.

(10) Patent No.: US 8,720,460 B2
(45) Date of Patent: May 13, 2014

(54) FIELD-DEPLOYABLE CABLE-SPLICING OUTDOOR-SHELTER

(75) Inventors: David Zhi Chen, Richardson, TX (US); Walter L. Thornton, Waterloo, NY (US)

(73) Assignees: Verizon New York Inc., New York, NY (US); Verizon Patent and Licensing Inc., Basking Ridge, NJ (US)

( * ) Notice: Subject to any disclaimer, the term of this patent is extended or adjusted under 35 U.S.C. 154(b) by 3 days.

(21) Appl. No.: 13/356,825

(22) Filed: Jan. 24, 2012

(65) Prior Publication Data

US 2013/0186444 A1 Jul. 25, 2013

(51) Int. Cl.
*E04H 15/04* (2006.01)
*E04H 15/60* (2006.01)

(52) U.S. Cl.
USPC ..... 135/90; 135/114; 135/900

(58) Field of Classification Search
USPC ..... 135/900, 114, 117, 21, 90, 99; 108/50.11, 50.02, 50.12
See application file for complete search history.

(56) References Cited

U.S. PATENT DOCUMENTS

| | | | | |
|---|---|---|---|---|
| 1,409,609 | A * | 3/1922 | Stockle | 135/96 |
| 1,581,180 | A * | 4/1926 | Csajaghy et al. | 135/150 |
| 3,406,698 | A * | 10/1968 | Hutchison | 135/92 |
| 4,922,942 | A * | 5/1990 | Schaeffer | 135/90 |
| 5,197,394 | A * | 3/1993 | Schmidt | 108/50.12 |
| 7,334,593 | B2 * | 2/2008 | Avery | 135/88.08 |
| 7,520,485 | B1 * | 4/2009 | Giannetto | 248/530 |
| 8,001,985 | B1 * | 8/2011 | Conner | 135/96 |
| 2007/0246091 | A1 * | 10/2007 | Becker | 135/16 |
| 2010/0163086 | A1 * | 7/2010 | Chavez et al. | 135/16 |

* cited by examiner

*Primary Examiner* — Noah CHandler Hawk

(57) ABSTRACT

Apparatus and methodology providing, a portable enclosed space in an outdoors setting, the space being free from environmentally-induced distractions. A technician can perform a mechanical or fusion splice on an optical fiber inside the space. Splicing or fusing miniscule optical fibers is challenging out of doors, particularly when distracted b wind, rain, snow, sun-glare, bugs, animals, etc. A tent is supported by a "spine" support structure modularly constructed by the technician in the outdoors location where an optical fiber operation shall take place. A splice-tray is affixed to the spine, the tray height being adjustable to accommodate that technician and provide an approximately horizontal work surface. The tent can be used on soft ground, hard pavement, leaning against utility poles or further supported by attachment to overhead cables. The technician can perform delicate operations on optical cables inside the tent with outside distractions mitigated.

19 Claims, 7 Drawing Sheets

FIELD-DEPLOYABLE CABLE-SPLICING OUTDOOR-SHELTER

BACKGROUND

Fiber-optic cable is now being widely deployed by telecommunication companies because it has advantages over copper wire cable, such as having much greater bandwidth. Each optical glass fiber in a multi-fiber fiber-optic cable has a glass core encapsulated by glass cladding, the clad core having an outside diameter on the order of 125 microns (μm). One micron is only one-thousandth of a millimeter or only about 0.000039 inches.

From time to time, these tiny glass fibers may need to be spliced together in the field during installation or when making modifications after installation. One splicing technique, called fusion splicing, is analogous to welding two pieces of metal together, and involves an electrical arc that melts the glass at the ends of the two fused-together fibers. A fusion splice can take a relatively long time to accomplish, perhaps as much as 45 minutes per splice. By comparison, a mechanical splice of an optical fiber requires far less time because it uses only physical contact between two end-faces (surfaces) of two different optical glass fibers, without melting the glass. But, because of the inherently small dimensions involved, quality mechanical splicing can be hard to accomplish, even under ideal working conditions.

Regardless of whether fusion, mechanical or some other splice technique is employed, attempting to splice together optical fibers in the field is very challenging and, if the field splicing operation must be performed in the out-of-doors, rather than in an enclosed building, then multiple environmental distractions may add to the challenge. For example, if one is trying to accomplish the delicate operation of fusing together or mechanically splicing two optical fibers having diameters of only 125 microns, then any gust of wind, any precipitation (rain, snow, hail, sleet, etc.), any insect bite suffered by the user, any animal nuisance, any excessive heat or sunlight glare and/or any other environmentally-caused perturbation can reduce the likelihood of a successful fusing/splicing operation.

What is needed, therefore, is an advantageous technique for separating the user-technician from the outdoors environment while, simultaneously, providing him/her with a virtually motionless, but otherwise portable, work surface for facilitating the fusing/splicing operation. The instant disclosure and claimed subject matter address this need.

DETAILED DESCRIPTION OF PREFERRED EMBODIMENTS

Figure 1A:
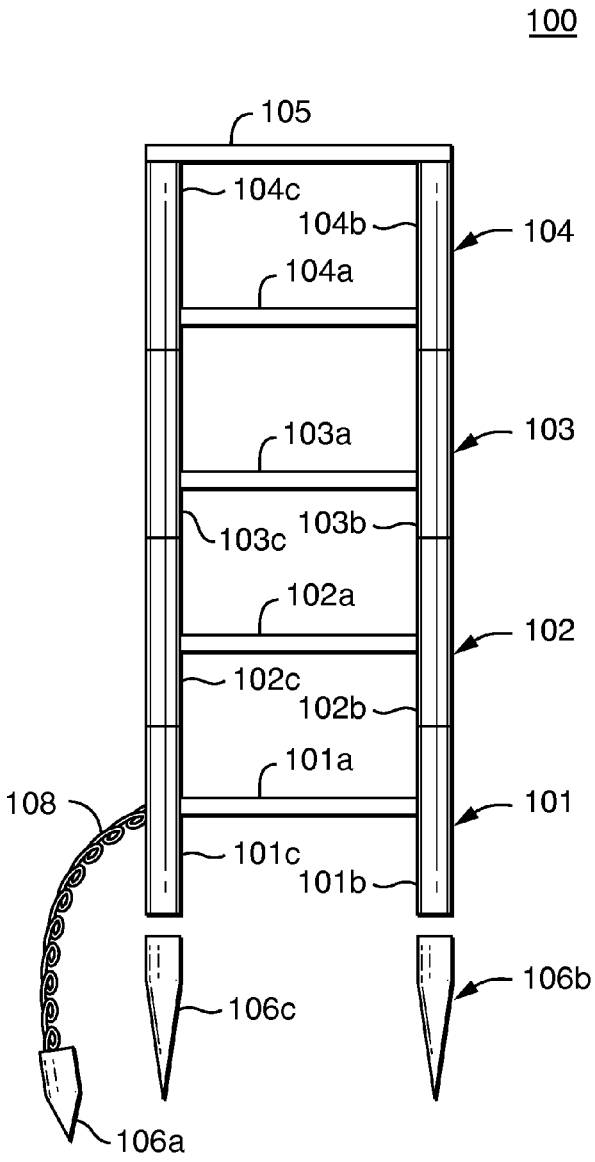
FIG. 1A is an exemplary schematic diagram of a modularly-configured outdoor-shelter spine support-structure (or "spine") according to an exemplary embodiment.

In this description, the same reference numeral in different Figs. refers to the same entity. Otherwise, reference numerals of each Fig. start with the same number as the number of that Fig. For example, FIG. 3 has numerals in the "300" category and FIG. 4 has numerals in the "400" category, etc.

In overview, various embodiments include apparatus and/or methodology for protecting, and separating, a user technician from outdoor distractions when he/she is performing a delicate optical fiber fusion or splicing operation in the out-of-doors.

In a particular embodiment, the apparatus includes a portable support structure or spine which is configured to be held in an upright and immobile position. A work surface is configured to be supported in an immobile and approximately horizontal position by/from the spine. The work surface can be formed as a tray, with an upright lip around the tray periphery to prevent loose items which are resting upon the surface of the tray to roll or slide off the tray. The tray has user-operable clamps, for clamping the tray upon the trunks of the spine at a location or height selected by the user. A tent, supported by the spine and enveloping the spine and the work surface, is configured to separate a user/technician, working at the work surface inside the tent, from environmental distractions occurring outside of the tent. The work surface is used for splicing or fusing optical fiber communication cable. If the spine is constructed from metal, such as aluminum, there is provided a safety grounding path, conductively connecting the spine to earth-ground.

More particularly, the spine comprises two linear and mutually parallel trunks interconnected by a plurality of horizontal spacers, each of the trunks having either a pointed earth-piercing shaft affixed at the bottom of the trunk for piercing the earth and implanting the spine firmly into the earth—or—each of the trunks fitting into a weighted boot-receptacle for holding the spine upright and immobile when the apparatus is located on a hard surface. The trunks comprise a plurality of trunk modules, each module having one spacer interconnecting two, or a pair of trunk segments, one segment forming a portion of one trunk and the other segment forming a portion of the other trunk. The trunk modules are modularly (matingly) inter-connected, one to another, in a manner to configure the spine. The trunk segments are each of sufficient length such that the plurality of trunk modules provides a total spine length (height) to accommodate the height of the user when standing upright inside the tent. The spine height is thereby adjustable as a function of the number of modules and the length of each module's pair of trunk segments, where each pair can be the same length as another pair, or where each trunk segment pair can be different in length from some or all of the other segment pairs.

In yet another feature, the top-most trunk module, or only the top-most trunk module, includes a horizontally-oriented curvilinear rib configured to provide a form to allow the tent material draped over the rib to define a periphery of the tent that allows adequate space for the user standing upright inside the tent. If the spine is to be supported by a generally horizontal cable running between two vertical utility poles, two encircling hooks are modularly-connected to the top-most trunk module, where the hooks are configured to encircle the horizontal cable. The tent accommodates these hooks by having zipper flaps that open to allow the hooks to penetrate therethrough. To mitigate effects of rainwater entering into the tent via the opened zipper flaps, a protective tarp, similar in function to an umbrella, is wrapped over the horizontal cable and snap-connected to the upper portion of the tent, thereby forming a water-runoff surface covering the openings in the tent through which the hooks have penetrated.

FIG. 1A is an exemplary schematic diagram of a modularly configured spine 100 according to an exemplary embodiment. Spine 100 includes a number of interconnected trunk modules 101, 102, 103 and 104 each having a horizontal spacer 101*a*, 102*a*, 103*a* and 104*a*, respectively, solidly connecting two trunk segments 101*b*/101*c*, 102*b*/102*c*, 103*b*/103*c* and 104*b*/104*c*, respectively. In other words, trunk segments 101*b* and 101*c*, and spacer 101*a*, for example, collectively form a solid structure, i.e., a trunk-module having a pair of trunk segments.

Each trunk segment can be a hollow cylinder or a hollow structure in accordance with another external configuration, to enable it to nest or snug-fit into an interfacing trunk segment, as shown, forming solid spine 100. Or, each trunk segment can be a solid cylinder or a solid structure in accordance with another external configuration but with an aperture at one of its otherwise solid ends to enable it to nest or snug-fit into an interfacing trunk segment, as shown, forming solid spine 100. In other words, the cross-section of the interfacing aperture in either the hollow or solid segment embodiments could be circular, triangular, square, rectangular, hexagonal, octagonal, etc. Similarly, the external cross section in either the hollow or solid segment embodiments can be circular, triangular, square, rectangular, hexagonal, octagonal, etc., and need not match its aperture cross section. In addition to the snug fit, there can be conventional spring-loaded buttons and apertures (not shown) associated with the trunk segments, so that a spring-loaded button on one segment will snap into such aperture on its adjacent mating segment when the segments are nested together; the buttons are pressed down to release them from the nesting condition.

Trunk-modules 101-104 can be made from metal (e.g., aluminum) or from hard plastic and other modules (not shown) can be added if more height is needed to form a spine that meets a height requirement for a particular user. Each of the modules can have trunk segments that are the same length from module to module, or they can have different lengths to enable a user to construct a total length spine of a particular height suitable to that particular user. Except for trunk module 104, the trunk modules are functionally identical. Module 104, being the top-most module in the group, has additional functionality. The tops of trunk segments 104*b/c* of uppermost module 104 further support a horizontally-oriented curvilinear rib 105, shown in FIG. 1A in a front view; this is further discussed in connection with FIG. 1B.

The combined length of trunk segments 101*b*, 102*b*, 103*b* and 104*b* form a trunk (hereinafter "trunk B") and the combined length of trunk segments 101*c*, 102*c*, 103*c* and 104*c* form another trunk (hereinafter "trunk C") the same length as trunk B. Trunks B and C are mutually parallel because the spacers 101*a*, 102*a*, 103*a* and 104*a* are all the same length. The bottom of trunk segment 101*b* can be nested into earth-piercing shank 106*b* and the bottom of trunk segment 101*c* can be nested into earth-piercing shank 106c. The shanks are inserted by a technician/user into earth soil to hold spine 100 upright. Ground wire 108, made from copper or other conductive material, is conductively connected between a trunk of spine 100 (when spine 100 is constructed from conductive metal such as aluminum) and grounding shank 106*a*, used for piercing earth-soil to ensure harmless conduction of extraneous electricity to ground; this is particularly important when utilizing boot 109 which is not implanted into the ground, discussed in connection with FIG. 1B. Alternatively, instead of using grounding shank 106*a* to pierce the soil, a large conductive metal clip (not shown) can be substituted for shank 106*a*, such clip configured to clamp onto a metal grounding rod (not shown) that was inserted into the ground, such clip and rod ensuring a safe grounding path from the metal ladder.

Figure 1B:
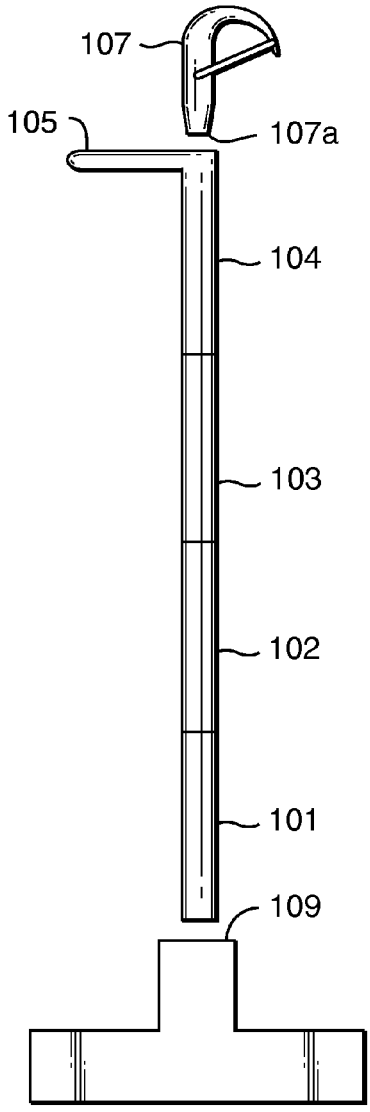
FIG. 1B is an exemplary side view of a portion of FIG. 1A, but with additional features according to an exemplary embodiment.

FIG. 1B is an exemplary side view of a portion of FIG. 1A, but with additional features according to an exemplary embodiment. In this view, horizontally-oriented curvilinear rib 105 is shown in side-view with its curvilinear central axis lying in a plane which is approximately perpendicular to the plane formed by the longitudinal axes of mutually-parallel trunks B and C. Rib 105 is used to push-out or drape a tent (not shown in this Fig.) to accommodate a user inside the tent; this is discussed below in connection with FIGS. 3A/3B. Weighted boot receptacle 109 is shown at the bottom of FIG. 1B and is a substitute base for earth-piercing shaft 106*b*. When spine 100 is to be erected on solid ground, like pavement or paved driveway, where the earth cannot be pierced and penetrated by shafts 106*b/c*, boot 109 can receive trunk B of module 101 and, together with its companion boot (not shown) hold spine 100 in an upright position. (There is a companion boot hidden from view by boot 109 in this Fig. which receives trunk C.) In a particular embodiment, the weight of boot 109 and the companion boot can be five-ten times, or more, the weight of spine 100 to provide stability. The fit between the boot and the segment is tight to ensure no wiggling of the spine. The boots could be made from lead.

Cable hook 107 is shown at the top of FIG. 1B. Cable hook shaft 107*a* can be snug-fit into an aperture (not shown) in trunk segment 104*b* (and can be further secured by a spring-loaded button and aperture scheme, discussed above). There is another cable hook (not shown in this Fig. because it is hidden from view by cable hook 107) which can be snug-fit into an aperture (not shown) in trunk segment 104*c*. These cable hooks, after secure insertion into their respective trunk segments, can be used to secure spine 100 to an overhead power line or communication line running between two vertical utility poles (not shown), while still being supported on the ground by, e.g., boots 109. The length of the spine would need to be elongated dramatically to accommodate the additional height of the horizontal cable (not shown) running above the ground by some 25 feet or more. This additional height can be accomplished quickly with larger trunk modules. The elongated spine is not used as a ladder, and another device, such as a ladder or a bucket truck is needed to work with this particular spine support. In an alternative embodiment, belts or straps (not shown) can be added, and securely connected, to trunk segments 104*b/c* of uppermost module 104 and/or elsewhere on trunks B and C to provide added security and stability. These belts/straps can be tightened around the overhead horizontal cable and buckled/locked to provide security in addition to hooks 107, tightened around a ladder (not shown) and buckled/locked if such ladder is being used in connection with spine 100, tightened around a vertical utility pole (not shown) and buckled/locked if spine 100 is placed against such pole, and tightened around suitable protuberances (not shown) projecting from a wall (not shown) if spine 100 is positioned near/against that wall.

Figure 2A:
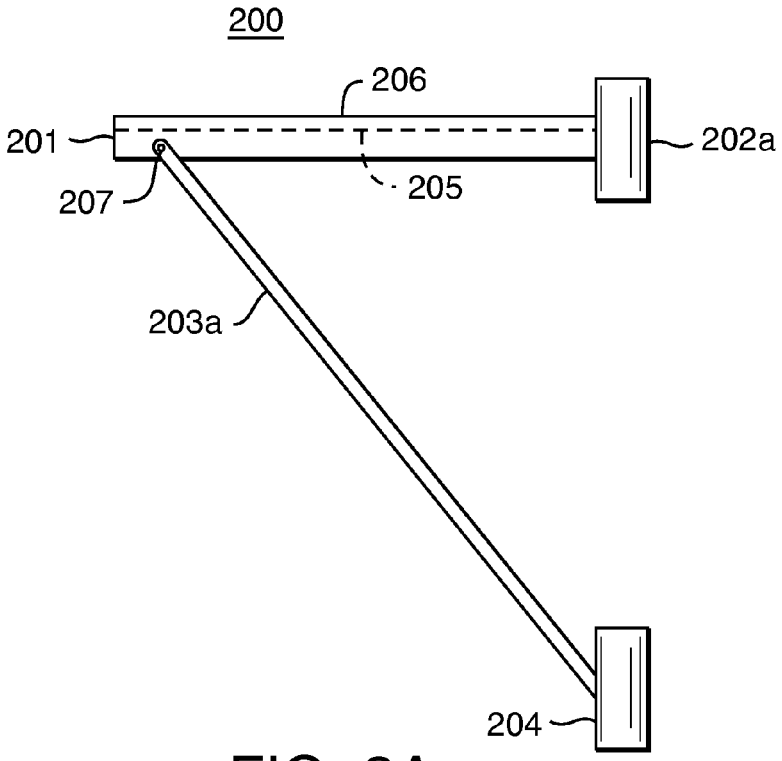
FIG. 2A is an exemplary schematic diagram of a side view of a work surface tray with clamps to connect it to the spine of FIG. 1A/1B.
Figure 2B:
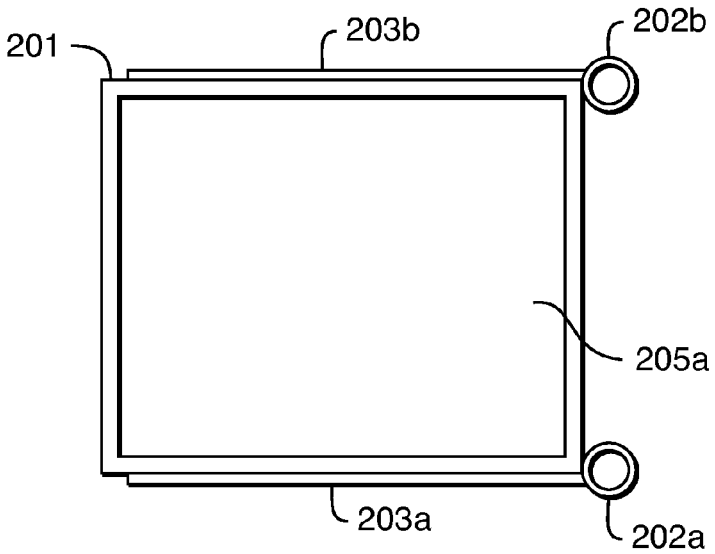
FIG. 2B is an exemplary schematic diagram of a top view of the work surface tray of FIG. 2A.

Referring to FIGS. 2A and 2B together, FIG. 2A is an exemplary schematic diagram of a side view of a work surface tray mechanism 200 and FIG. 2B is a top view of the mechanism of FIG. 2A. Tray 201 is shown in FIG. 2A in a side view with dashed line 205 being a hidden line representing the edge of the work surface of the tray. In FIG. 2B, tray surface 205*a* represents the surface corresponding to edge of surface 205. The distance between the top of side wall 206 in FIG. 2A and dashed line 205 represents the height of the lip or flange that rises above, and encompasses, the periphery of work surface 205. The lip is configured to prevent small items used by the technician/operator in the splicing/fusing operation to roll or slide off the work surface.

Tray 201 is pivotably connected by a pin 207 to clamp 202*a* which can be slidably positioned over, and clamped to, trunk C. Tray 201 is also pivotably connected, similarly, to clamp 202*b* (shown in FIG. 2B but hidden from view in FIG. 2A) which can be slidably positioned over, and clamped to, trunk B. Tray 201 is further pivotably connected to brace or truss support 203*a* which, in turn, is pivotably connected to clamp 204 which, in turn, can be slidably positioned over, and clamped to, trunk C. Tray 201 is yet further pivotably connected to brace or truss support 203*b* (shown in FIG. 2B but hidden from view in FIG. 2A) which, in turn, is pivotably connected to a companion clamp (hidden from view in both FIG. 2A and FIG. 2B) which, in turn, can be slidably positioned over, and clamped to, trunk B. similar to how clamp 204 clamps to trunk A.

The work surface is approximately horizontal, and its precise horizontal orientation is a function of where the various clamps are clamped on trunks B and C and whether or not the spine is implanted or booted in a vertical orientation. Even if the spine is constrained to not be vertical because, e.g., its boots rest upon a hard pavement that is inclined where the boots orient the spine in other than a vertical direction, the tray can still be adjusted towards the horizontal because clamp 204 and its companion clamp can be separately adjusted up or downwhile clamps 202*a/b* remain in a fixed position on the trunks. And, even if tray surface 205*a* does not achieve perfect horizontal orientation, that does not diminish the functionality of the tray as serving as an appropriate work surface for fusion/splicing operations because perfect horizontal orientation is not essential and the peripheral lip 206 on the tray holds all loose items on the surface. However, the tray should be held virtually motionless.

Figure 3A:
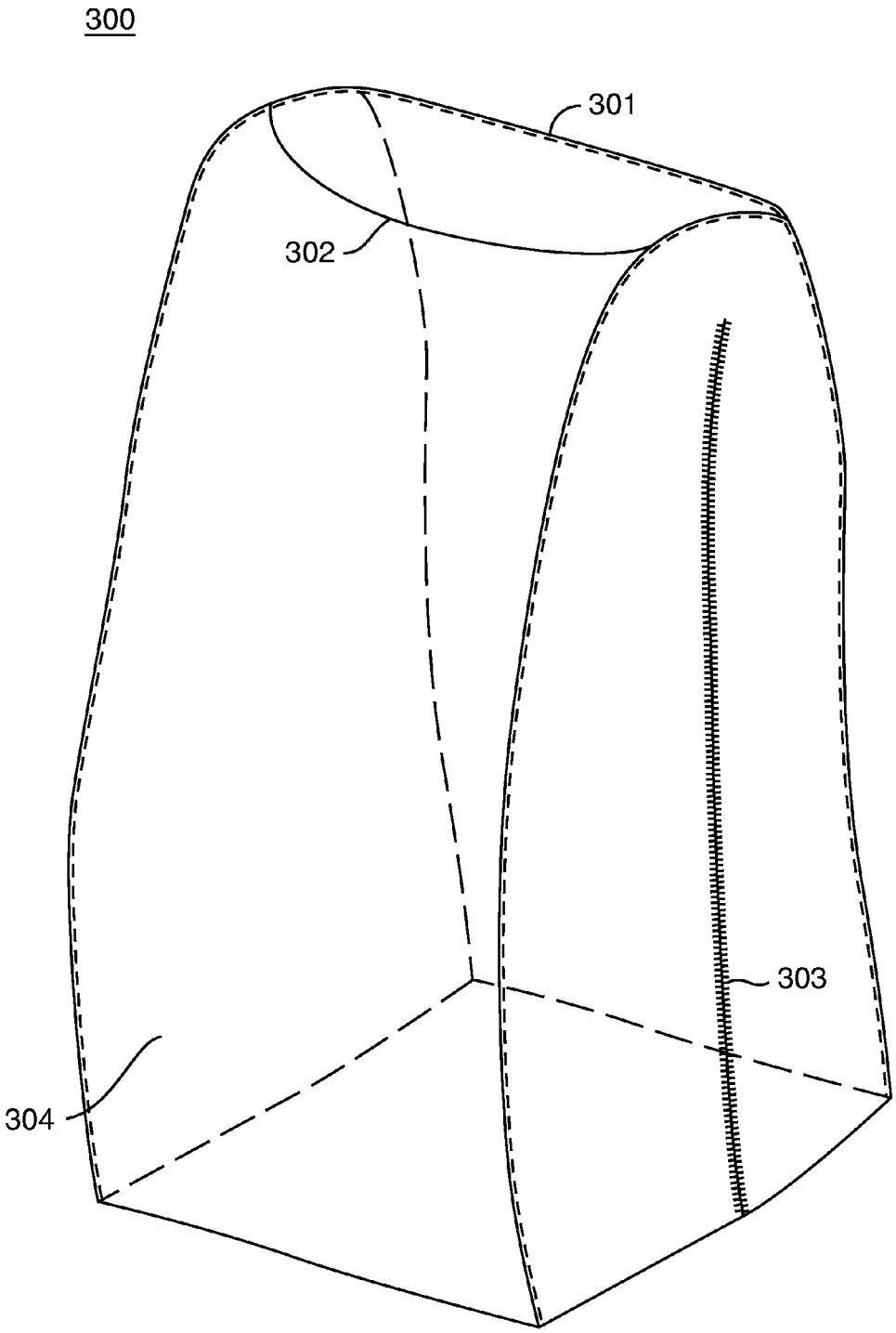
FIG. 3A is an exemplary schematic diagram, in perspective, of a tent structure suitable for use with the spine of FIGS. 1A/1B and tray of FIGS. 2A/2B.

FIG. 3A is an exemplary schematic diagram, in perspective, of a tent 300 suitable for use with the spine of FIGS. 1*a*/1*b* and tray of FIGS. 2*a*/2*b*. Material of tent 300 may be typical tent material or may be nylon or canvas or other plastic water repellant and wind resistant material. Edge 301 is the outline formed by a spreader rod (not shown) located under the edge inside tent 300, the rod being used to spread the tent material apart; the rod may be permanently sewn into the tent material. The rod, sewn-in, or otherwise, rests generally at the top of spine 100. Crease 302 is the outline formed by rib 105 pushing out and supporting the tent material 304 from inside the tent. Work surface tray 201 is on the same side of the spine as rib 105, whereby the tent accommodates, and offers room to, a technician when working inside the tent at that tray. Zipper 303 is approximately vertically oriented when the tent is hung over spine 100 and is used for ingress/egress of the technician-user with respect to tent-enclosed space. Zipper 303 can be zipped closed to mitigate wind, bugs, rain etc.

Figure 3B:
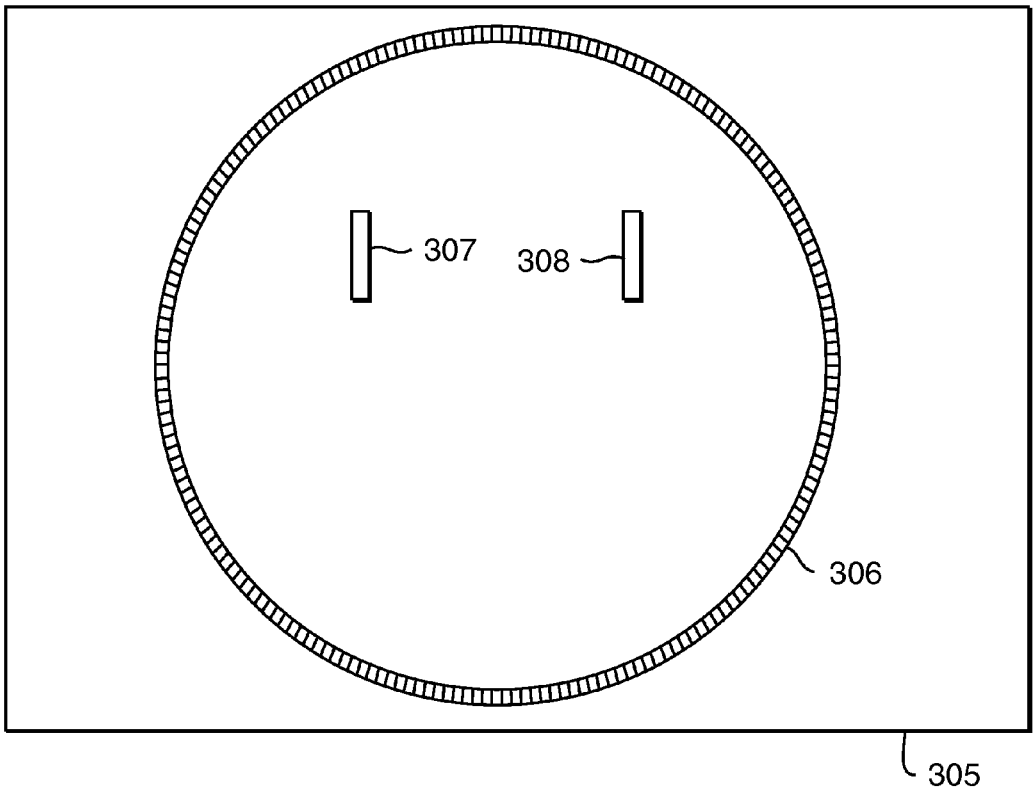
FIG. 3B is an exemplary schematic diagram of a bottom piece or mat for the tent structure of FIG. 3A.

FIG. 3B can be a bottom piece of tent material or, preferably, water-impervious mat material which can be stiff and more robust than the tent material. This bottom piece is used as a ground-covering or floor for the tent. Zipper portion 306 is essentially circular and can be attached to its mating zipper portion (not shown) at the bottom of tent 300. When zipped closed, the bottom piece forms an almost impervious barrier to ground water, insects crawling on the ground, animals and other ground-located environmental distractions. When zipped closed and combined with a closed vertical zipper 303, the space inside tent 300 is virtually isolated and insulated from most external environmental distractions to a large degree, thereby providing a relatively tranquil space inside the tent in which the protected technician can perform his/her delicate fusion or splicing operation on tray 201.

However, even with both zippers zipped closed, the enclosed tent space is not completely sealed, at least because of formed apertures 307 and 308 in mat 305. These apertures are precisely separated in the mat to receive earth-piercing shafts 106*b*/106*c* there-through at the appropriate separation to accommodate trunks B and C, respectively, when positioning the spine on ground soil.

Therefore, the mat can be laid-down on the soft earth first, then pointy shafts 106*b*/106*c*, either empty or holding trunks B and C can be inserted through the holes into the earth and then the spine can be inserted into the positioned shafts and held in a vertical orientation. Then, tray 201 is clamped to trunks B and C at an appropriate height for the technician and adjusted to be horizontal, after which tent 300 is draped over the immobile spine and tray. Finally, the technician can enter the tent space via open zipper 303 (or can enter via the open bottom of the tent), can then zipper-close mat 305 to the bottom of the tent and can then zipper-close vertical zipper 303. However, if boots 109 are used instead of shanks 106*b/c* because the operation is taking place on a paved surface, the sequence of fabrication of the tent shelter can be the same but the boots shall cover holes 307/308 instead of penetrating them. Other sequences of assembly can also be followed as discussed with respect to FIGS. 4A/B.

Figure 3C:
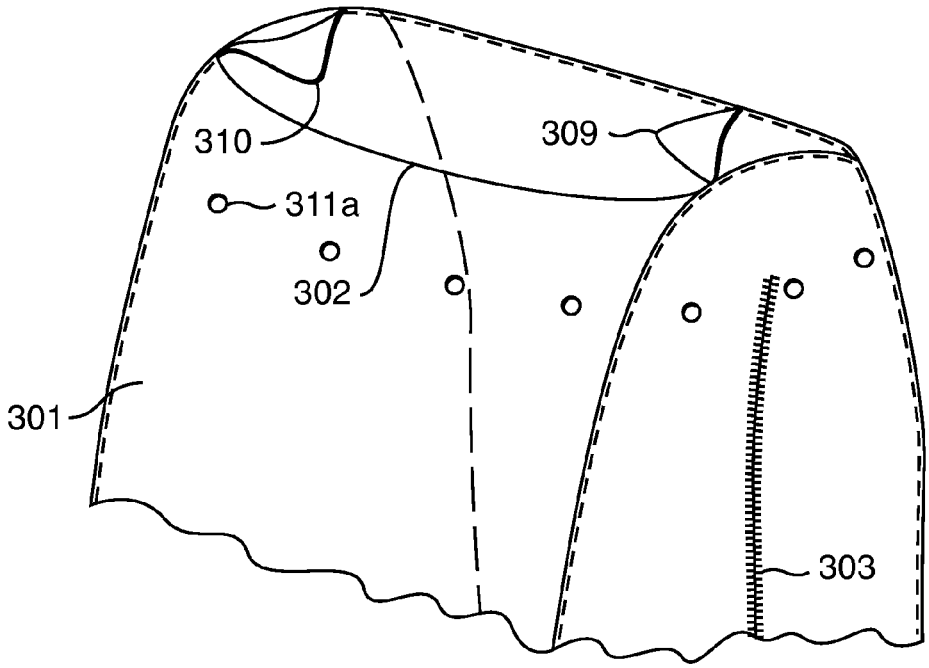
FIG. 3C is a portion of the tent structure of FIG. 3A in perspective, but also shows flaps for accommodating security hooks and shows snaps to accommodate a protective canopy.

FIG. 3C is a portion of the tent structure of FIG. 3A in perspective, but also shows zipper-flaps for allowing pass-through of security cable hooks as well as snaps to connect to a protective canopy. When spine 100 is additionally supported from a horizontal wire or cable running between two vertical utility poles (not shown), and uses security cable hook(s) 107 to latch-over the horizontal wire or cable, there needs to be openings in the tent through which those hooks can be inserted. These openings are created in FIG. 3C by open flaps 309 and 310 which are otherwise zipper-closed. In the event that there is precipitation (rain, etc.) when tent 300 is being used on a horizontal cable in this manner with open flaps 309/310, there needs to be a protective cover over those exposed apertures to keep the rain out of the tent. For that purpose, snaps 311*a* are provided.

Figure 3D:
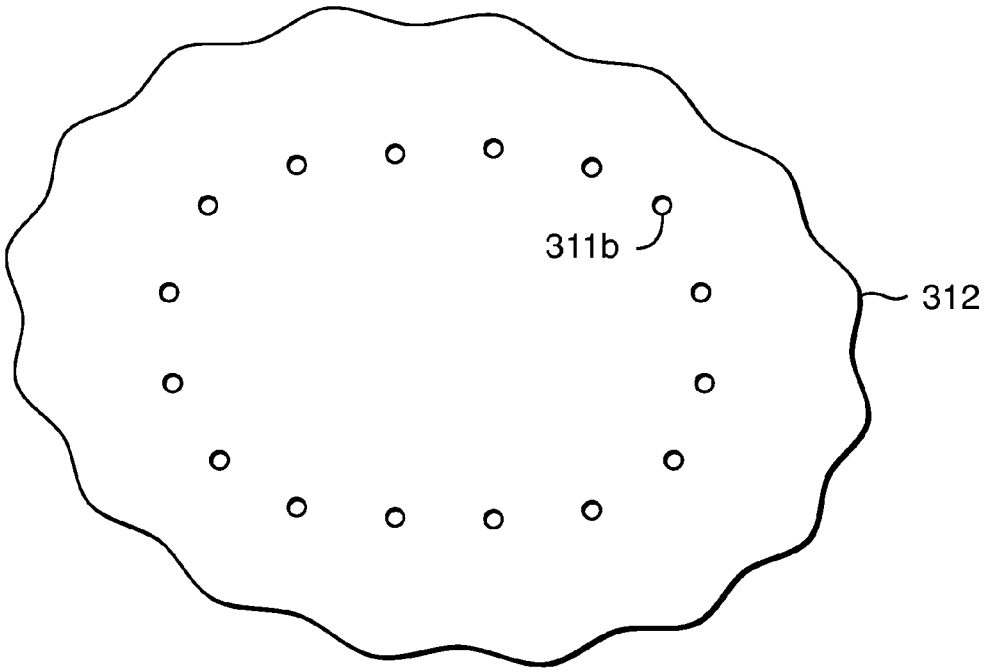
FIG. 3D is a protective canopy to be used in connection with FIG. 3C.

FIG. 3D shows protective cover or tarp 312, which can be made from the same material as the tent. There is a plurality of snap receptacles 311*b* to receive only snaps 311*a* of FIG. 3C. Tarp 312 is placed over the horizontal cable (not shown) from which spine 100 is supported via hook-latch 107 (and its companion latch for trunk B, the companion latch not visible in FIG. 1B), and the tarp is snapped in place with snaps 311*a*/311*b*. This in-place tarp covers the otherwise exposed opening crated by flaps 309/310, and functions like an umbrella to prevent rain from entering those openings.

When spine 100 is attached to a horizontal wire or cable running between two vertical utility poles (not shown), by using security hook 107 connected to trunk B and its companion hook (not shown) connected to trunk C, spine 100 must have previously been elongated by adding other modules to modules 101, 102, 103, and 104 so that spine 100 can reach from the ground to the elevated cable. Its bottom-most module can be inserted into boot(s) 109 or into shanks 106*b/c* depending on which is used based on ground details. The tray under the tent connected to the spine steadied by the horizontal wire is accessible by a technician via a separate ladder propped up against that horizontal cable. Such a ladder is shown in U.S. patent application Ser. No. 12/492,325, filed Jun. 26, 2009, entitled FALL-ARREST LADDERS SYSTEM, assigned to the assignee of the present application, and hereby incorporated herein by reference in its entirety.

The tray in this scenario is also accessible by a technician via an elevated bucket in a bucket truck. The tent used in this elevated bucket truck instance may be a fuller or larger version of that used in the previous on-the-ground scenario to enable the tent material to also drape over the elevated bucket in which the user is standing. Either this procedure, or the ladder procedure, is used for accessing splicing tray 201 which is substantially above ground in this overhead wire scenario.

Figure 4A:
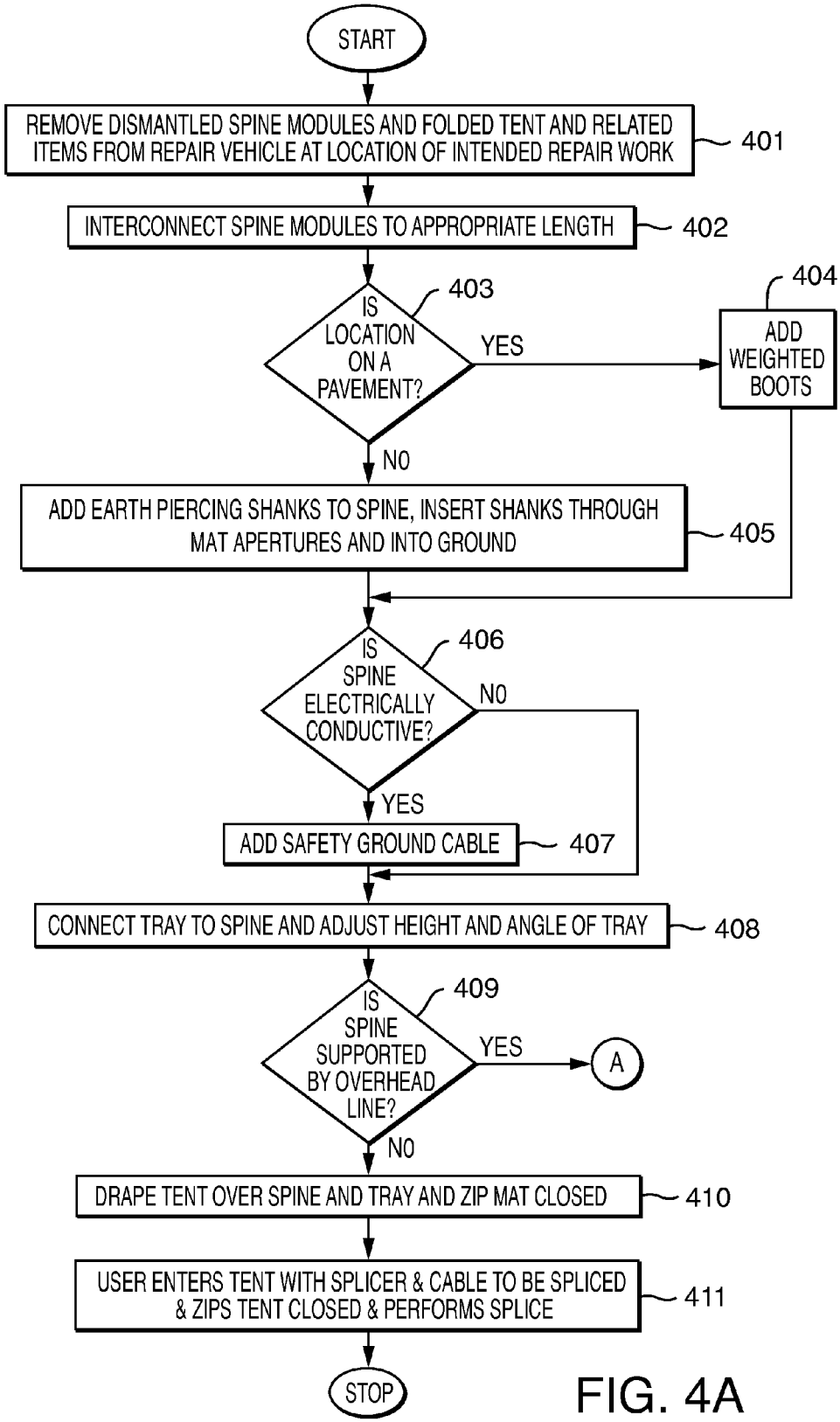
FIG. 4A is a flowchart showing methodology employed by a user technician applying embodiments depicted in FIGS. 1-3 if the spine is not supported by overhead cable.

FIG. 4A is a flowchart showing methodology employed by a user technician applying embodiments depicted in FIGS. 1-3 when the spine is not supported by overhead cable. The technician arrives at the location where the cable requires a splicing operation, typically in a repair truck. The spine modules are transported loosely, i.e., disconnected from each other while being transported in the truck along with a folded-up tent. In step 401 the technician removes the modules, the tent, the tray mechanism and any other related items from the vehicle. In step 402 the technician constructs the spine by interconnecting the spine modules as described above. In step 403, a query is made: is this repair location on pavement (or other hard surface)?

If no, the algorithm moves to step 405 where the technician places floor mat 305 upon a selected location on the soil convenient to the optical cable joint to be spliced, and inserts earth-piercing shanks 106*b/c* through apertures 307/308 into the soil either before or after he/she inserts trunks B and C into the shanks. This provides an upright spine planted in the soil. But, if yes, the algorithm instead moves to step 404 where the technician places floor mat 305 upon a selected location on the pavement convenient to the optical cable joint to be spliced, and then places weighted boots (one boot 109 hiding the other from view in FIG. 1B) over apertures 307/308 in the floor mat, and trunks B and C are inserted into the weighted boots. This also provides an upright spine, but on hard pavement instead of soft soil.

Regardless of which upright spine approach is taken, a query is made in step 406: is the spine electrically conductive? If yes, then in step 407, electrically conductive ground cable 108 is connected between spine 100 and earth by way of shank 106*a*. In the event that the hard surface scenario is extant, ground cable 108 is long enough to permit it to be planted in adjoining soil. Then, in step 408, a tray is connected to the spine and it is adjusted in height and angular orientation to make it as horizontal as possible.

In step 409 a query is made: is the spine additionally supported by an overhead cable (telephone cable, fiber-optic cable, other utility cable some 20-30 feet above ground) running between two vertical utility poles? If not, then the algorithmic process moves to step 410 where the technician drapes the tent over the spine and the attached tray, and zips closed the floor mat to the bottom of the tent. Then, in step 411, the user/technician enters the tent, places the splicer on the tray along with cables to be spliced, zips closed the side opening through which he entered the tent and performs the splice/fusion operation. The process, if not involved with an overhead line support, is then completed. But, in step 409, if the spine were additionally supported by an overhead line, the process would have moved instead to "A" in FIG. 4B.

Figure 4B:
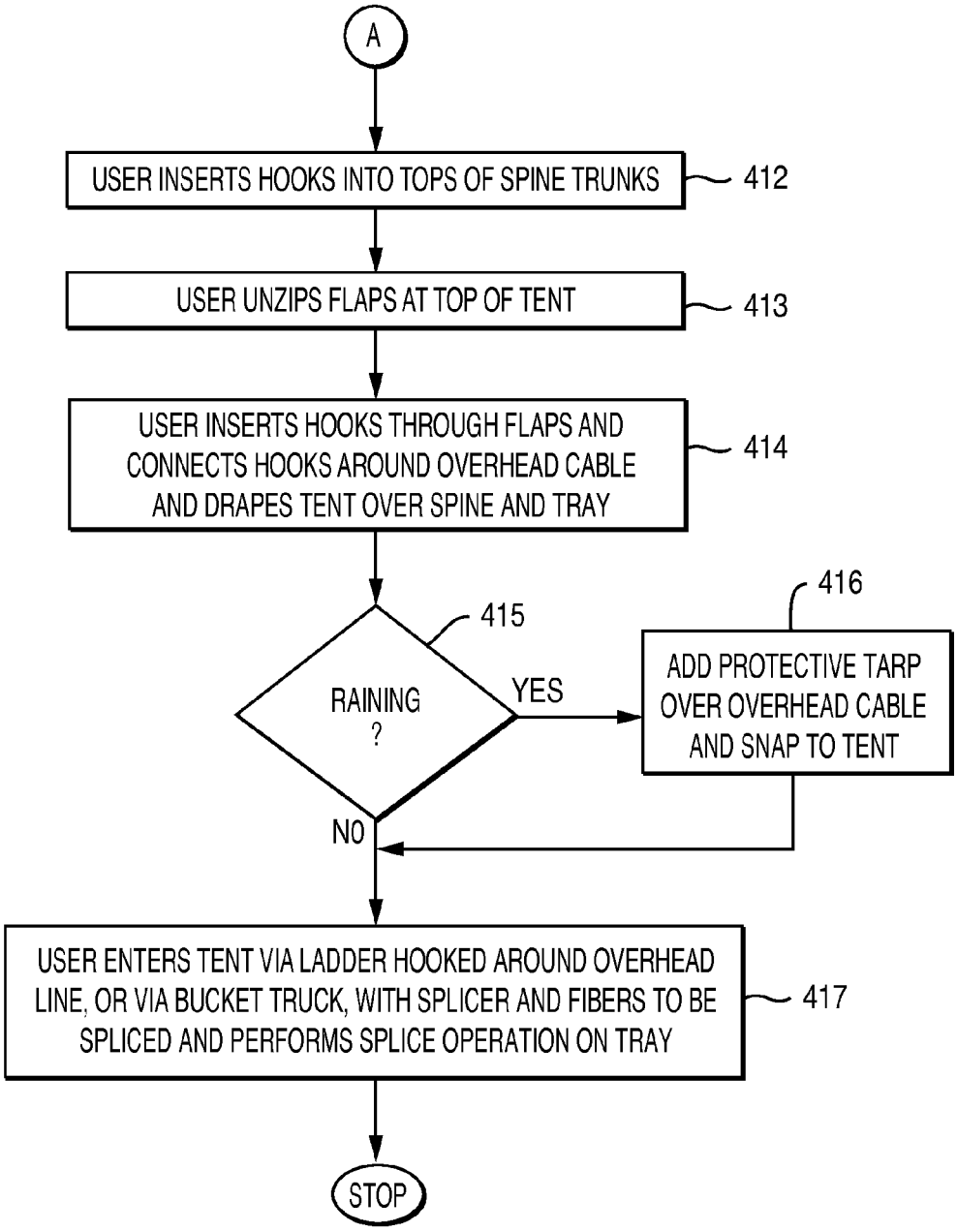
FIG. 4B is a flowchart connected from FIG. 4A showing methodology employed by a user technician applying embodiments depicted in FIGS. 1-3 when the spine is further supported by overhead cable.

FIG. 4B is a flowchart connected from FIG. 4A showing methodology employed by a user technician applying embodiments depicted in FIGS. 1-3 when the spine is supported by overhead cable. As noted above, in step 408, the tray was connected to the spine. Thereafter, in this instant scenario, in step 412, the user inserts hooks into tops of the spine trunks for latching around the elevated cable. In step 413, the user unzips two flaps at the top of the tent, to allow openings for the hooks to be inserted there-through. In step 414 the user inserts hooks 107 through flaps 309/310, connects the hooks around the overhead cable to provide a stable support for the upper portion of the spine, in combination with the ground support of boot 109 or shanks 106*b/c* depending on the ground condition, and drapes the tent over the spine and attached tray.

Next, in query step 415, it is determined if rain or other precipitation is impacting the tent. If not, in step 417, while holding the splice mechanism and the cable to be spliced, the technician enters the tent, (which is now off the ground being suspended from the spine hooked over the overhead cable), by way of a ladder or a bucket from a bucket truck, and performs the splice or fusion operation. If a ladder is used, it also may be stabilized by hooks over the horizontal cable (e.g., the ladder disclosed in the incorporated by reference patent application).

But, if there is rainy weather, after the user inserts hooks through the tent flaps and connects the hooks around the overhead cable, and drapes the tent over the spine and attached tray per step 414, the user then wraps protective tarp 312, in step 416, over the overhead cable and connects it via snaps 311*a/b* to the tent. This forms a water-runoff shield, like an umbrella, to keep the rainwater out of apertures in the tent associated with open flaps 309 and 310. Thereafter step 417 is performed as described above and the process terminates.

In this specification, various preferred embodiments have been described with reference to the accompanying drawings. It will, however, be evident that various modifications and changes may be made thereto, and additional embodiments may be implemented, without departing from the broader scope of the invention as set forth in the claims that follow. For example, the spine could be leaned against a vertical utility pole, in addition to the other supports disclosed. The present invention is thus not to be interpreted as being limited to particular embodiments and the specification and drawings are to be regarded in an illustrative rather than restrictive sense

What is claimed is:

1. Apparatus, comprising;

a portable spine configured to be supported in an upright and immobile position;

a work surface configured to be supported in an immobile and approximately horizontal position by said spine; and a tent, supported by said spine and enveloping said spine and said work surface, configured to separate a user working at said work surface inside said tent from environmental distractions occurring outside said tent;

wherein said portable spine comprises two linear and mutually parallel trunks interconnected by a plurality of horizontal spacers, each of said trunks having an earth-piercing shaft affixed at bottom of said trunk for implanting said spine firmly into the earth.

2. The apparatus of claim 1 wherein said work surface is a communication cable splicing work surface.

3. The apparatus of claim 2 wherein said communication cable is at optical-fiber cable.

4. The apparatus of claim 2 wherein said work surface is a tray with an upright lip around the periphery of said tray to prevent loose items resting upon surface of said tray to roll or slide off said tray.

5. The apparatus of claim 4 wherein said tray is sufficiently large to accommodate said user working to splice said communication cable.

6. The apparatus of claim 5 wherein said tray further comprises user operable clamps for clamping said tray in a stabilized manner at a desired height on said trunks of said spine.

7. The apparatus of claim 6 wherein said tray further comprises truss supports connecting said tray to said trunks of said spine at locations below said desired height to further stabilize said tray in said immobile position.

8. The apparatus of claim 1 wherein said trunks comprise a plurality of trunk-modules, each of said modules having one of said horizontal spacers interconnecting two trunk segments, one segment forming a portion of one of said trunks and the other segment forming a portion of the other of said trunks, each of said plurality of trunk modules matingly connecting to another of said plurality of trunk modules in a manner to configure said spine.

9. The apparatus of claim 8 wherein said trunk segments are each of sufficient length such that said plurality of trunk segments, when interconnected and upright, configure said spine at a length adequate to accommodate height of said user when standing upright inside said tent, said height of said spine thereby being adjustable as a function of the number of said trunk segments where each of said segments is either the same length or is different in length from other of said segments.

10. The apparatus of claim 9 wherein a particular one of said trunk modules is positioned only at the top end of said plurality of interconnected trunk segments, said particular trunk module including a horizontally-oriented curvilinear rib configured to allow material of said tent draped over said rib to define a periphery of said tent that allows adequate space for said user standing upright inside said tent.

11. The apparatus of claim 10 wherein said particular trunk module further comprises trunk segments each configured to receive a user-operated and cable-enveloping hook mechanism, fir hooking around a horizontal cable strung above ground between two utility poles.

12. The apparatus of claim 1 wherein said spine is constructed from metal, and further comprising a safety grounding path, conductively connecting said spine to earth-ground.

13. The apparatus of claim 1 wherein said tent further comprises a vertical opening closable via a zipper operable from inside said tent to permit said user to enter said tent and zip closed said tent around said user.

14. The apparatus of claim 13 further comprising a ground tent mat which is zipper-connectable around the periphery of said mat to a bottom periphery of said tent to prevent bugs, animals, water and/or other environmental distractions from entering into said tent on said ground.

15. The apparatus of claim 13 further comprising an inclement weather protective tarp optionally used only when said spine is supported by a horizontal cable suspended between two vertical utility poles via hooks connected from top of said spine hooking around said cable, said tarp being wrapped over said cable and the upper portion of said tent, thereby forming a water-runoff surface covering openings in said tent through which said hooks have penetrated to prevent said water from entering said openings during said inclement weather.

16. The apparatus of claim 15 wherein said tarp and said tent both include snap connectors by which said tarp is snap-connected by said user to the exterior of said tent at the upper end of said spine.

17. The apparatus of claim 16 wherein said openings in said tent are normally sealed shut via zippers when said spine is not supported via said horizontal cable suspended between said two vertical utility poles.

18. Apparatus, comprising:

a portable spine configured to be supported in an upright and immobile position wherein said portable spine comprises two linear and mutually parallel trunks interconnected by a plurality of horizontal spacers, and at least one of: each of said trunks having an earth-piercing shaft affixed at bottom of said trunk for implanting said spine firmly into the earth or bottom ends of said trunks each fitting into a weighted boot-receptacle for holding said spine upright and immobile when said apparatus is located on a hard surface;

a work surface configured to be supported in an immobile and approximately horizontal position by said spine;

a tent, supported by said spine and enveloping said spine and said work surface, configured to separate a user working at said work surface inside said tent from environmental distractions occurring outside said tent, wherein said tent further comprises a vertical opening closable via a zipper operable from inside said tent to permit said user to enter said tent and zip closed said tent around said user; and an inclement weather protective tarp optionally used only when said spine is supported by a horizontal cable suspended between two vertical utility poles via hooks connected from top of said spine hooking around said cable, said tarp being wrapped over said cable and the upper portion of said tent, thereby forming a water-runoff surface covering openings in said tent through which said hooks have penetrated to prevent said water from entering said openings during said inclement weather.

19. Apparatus, comprising:

a portable spine constructed from metal and configured to be supported in an upright and immobile position;

a work surface configured to be supported in an immobile and approximately horizontal position by said spine; and a tent, supported by said spine and enveloping said spine and said work surface, configured to separate a user working at said work surface inside said tent from environmental distractions occurring outside said tent;

wherein said portable spine comprises two linear and mutually parallel trunks interconnected by a plurality of horizontal spacers, and at least one of: each of said trunks having an earth-piercing shaft affixed at bottom of said trunk for implanting said spine firmly into the earth or bottom ends of said trunks each fitting into a weighted boot-receptacle for holding said spine upright and immobile when said apparatus is located on a hard surface, and further comprising a safety grounding path, conductively connecting said spine to earth-ground.

* * * * *